US005507578A

United States Patent [19]

Ozeri et al.

[11] Patent Number: 5,507,578

[45] Date of Patent: Apr. 16, 1996

[54] DEVICE FOR GIVING PROPER SHAPE TO BAGS FOR DISPLAY PURPOSES

[75] Inventors: Victor Ozeri, Hong Kong, Hong Kong; Max J. Silk, Old Bridge, N.J.

[73] Assignee: Holiday Fair, Inc., New York, N.Y.

[21] Appl. No.: 280,401

[22] Filed: Jul. 25, 1994

Related U.S. Application Data

[63] Continuation of Ser. No. 438,470, filed as PCT/GB89/00354, Apr. 5, 1989, abandoned.

[30] Foreign Application Priority Data

Apr. 5, 1988 [GB] United Kingdom ..... 8807899

[51] Int. Cl.[6] ..... B65D 33/16

[52] U.S. Cl. ..... 383/127; 383/3; 383/44; 383/48; 383/94; 383/111; 206/522

[58] Field of Search ..... 383/3, 127, 44, 383/48, 94, 111, 902, 904; 206/522; 190/107

[56] References Cited

U.S. PATENT DOCUMENTS

| | | | |
|---|---|---|---|
| D. 316,633 | 5/1991 | Markowitz | D3/54 |
| 1,756,048 | 4/1930 | Williams | 383/3 X |
| 2,696,342 | 12/1954 | Toborg | 383/44 |
| 2,804,257 | 8/1957 | Hasler et al. | 383/44 X |
| 3,251,075 | 5/1966 | Saltness et al. | 383/3 X |
| 3,297,152 | 1/1967 | Corella et al. | 383/48 X |
| 3,707,225 | 12/1972 | Miles et al. | 206/522 X |
| 4,434,893 | 3/1984 | Barlow | 206/522 |
| 4,489,833 | 12/1984 | Bauer | 383/3 X |
| 4,793,123 | 12/1988 | Pharo | 206/522 X |
| 4,801,213 | 1/1989 | Frey et al. | 383/3 |
| 4,858,755 | 8/1989 | Kuivanen | 383/3 X |
| 4,872,558 | 10/1989 | Pharo | 383/3 X |

FOREIGN PATENT DOCUMENTS

| | | | |
|---|---|---|---|
| 0300094 | 1/1989 | European Pat. Off. | 383/44 |
| 2417448 | 10/1979 | France | 206/522 |

*Primary Examiner*—Allan N. Shoap
*Assistant Examiner*—Jes F. Pascua
*Attorney, Agent, or Firm*—Townsend and Townsend and Crew

[57] ABSTRACT

A device for giving proper shape to a bag (24) or the like for display purposes comprises an inflatable member (10) which is so designed and arranged to be placed inside the bag or the like to be displayed, and which when inside the bag is capable of then being inflated outwardly to cause the bag to move outwardly to its full and expanded size.

9 Claims, 2 Drawing Sheets

DEVICE FOR GIVING PROPER SHAPE TO BAGS FOR DISPLAY PURPOSES

This is a continuation of application Ser. No. 07/438,470, filed as PCT/GB89/00354, Apr. 5, 1989, now abandoned.

This invention relates to a device for giving proper shape to sports bags, holders, tucksacks, handbags, schoolbags, luggage, travel bags, or the like, for display purposes in a store.

At present, when a bag or the like is about to be displayed in a store for sale, the inside of the bag is manually stuffed with paper in order to give some shape to the bag whilst it is displayed in a store. Unfortunately, this, paper stuffing is extremely time-consuming and also does not display the bag at its full and proper shape, since the bag is usually not expanded outwardly to its full and, proper size leaving a number of creases on the exterior of the bag.

In accordance with the present invention, a device for giving proper shape to a bag or the like for display purposes comprises an inflatable member which is so designed,and arranged to be placed inside the bag or the like, to be displayed, and which when inside the bag is capable of then being inflated outwardly to cause the bag to move-outwardly to its full and expanded size.

Suitably, such an arrangement causes the bag to expand to such a degree that the full and correct external shape of the bag is reached, and also no creases are left on the exterior of the bag to provide a visually pleasing appearance. Such an arrangement allows the bag to be displayed in the store to show its full potential.

Suitably, the inflatable member is a plastic bag configuration, having one inlet through which air or the like is passed to blow up and expand the inflatable member.

Suitably, the inflatable member has an inflated shape corresponding substantially to the full and expanded shape of the bag, such that the inflatable member causes the external shape of the bag to obtain its full and proper size and, to remove any creases or the like thereon. Preferably, the inflatable member has an uninflated shape corresponding to the cross-sectional shape of the bag along the vertical plane on the longitudinal axis thereof.

Suitably, the inflatable member comprises two sheets of plastic, heat-sealed substantially around the circumference thereof in order to produce the inflatable member.

An exit at one point on the circumference of the inflatable member is provided, however, through which air or the like can be passed in order to expand the inflatable member.

Suitably, at the place a bag is manufactured, an inflatable member uninflated is placed within the bag for transport to a store or nearby place, whereafter prior to display in the store the inflatable member is blown up in order to put the bag in a display mode. Furthermore the inflatable member is of such strength that it can be punctured by a pin or the like, whereby when a bag in a store is sold, the inflatable member can be simply punctured with a pin to cause deflation, the inflatable member removed from the bag and disposed, and the bag folded for packing or the like.

The exit is advantageously provided with an air lock device to prevent air from escaping temporarily until the inflatable member is fully expanded and the exit is properly sealed.

Suitably, the exit of the inflatable member is permanently closed by heat-sealing when the inflatable member is fully expanded in order to prevent air from escaping from the inflatable member.

Preferably, the air pressure used to inflate the inflatable member is approximately 75 PSI, while the plastic used is poly vinyl chloride.

The invention will now be described by way of example with reference to the accompanying drawings in FIG. 1 is a side view of an inflatable member in its non-blown up mode;

Figure 1:
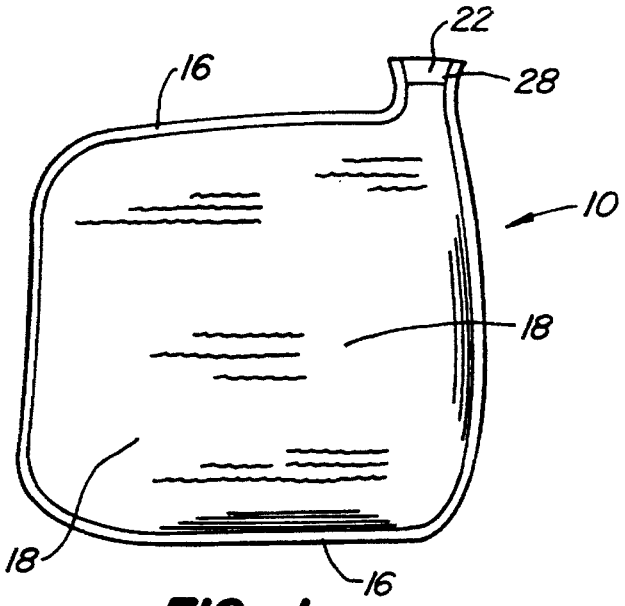
Figure 2:
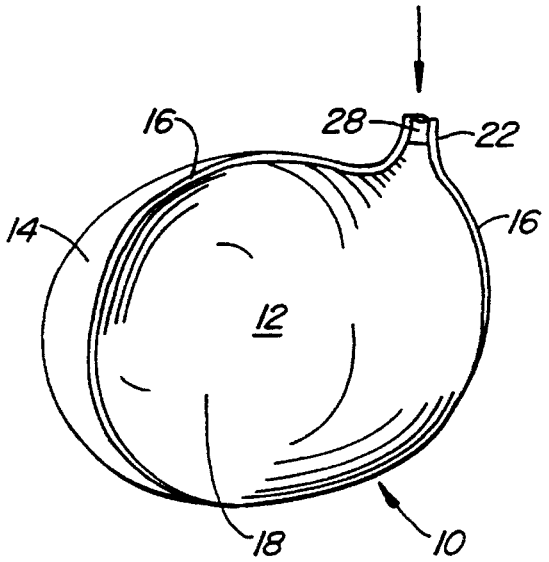
FIG. 2 is a perspective view of the inflatable member in its blown up mode.

The inflatable member 10 shown in FIGS. 1 and 2 is shown in a non-blown up mode in FIG. 1, and in a blown up mode in FIG. 2.

The inflatable member 10 is made from two sheets 12 and 14 of poly vinyl chloride heat-sealed (see 16) substantially around the circumference of the two sheets in order to substantially join the two sheets 12 and 14 together to form an inner containment region 18. The two sheets are not heat-sealed totally around the circumference, but rather are heat-sealed substantially around the circumference to leave an entrance 22 through which air can be passed into the inner containment area 18.

Figure 3:
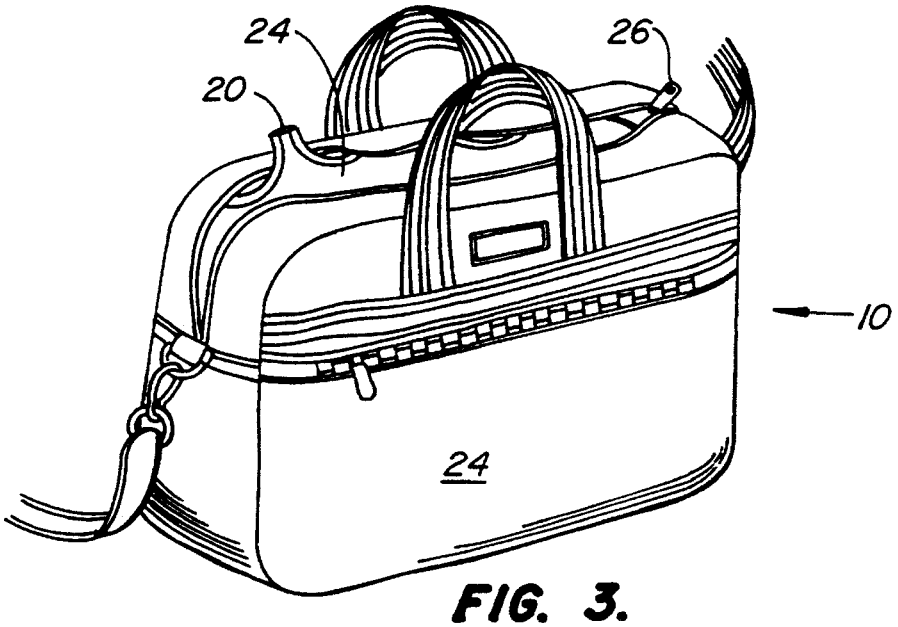
FIG. 3 is a perspective view of a bag within which an inflatable member as shown in FIG. 2 is placed.
Figure 4:
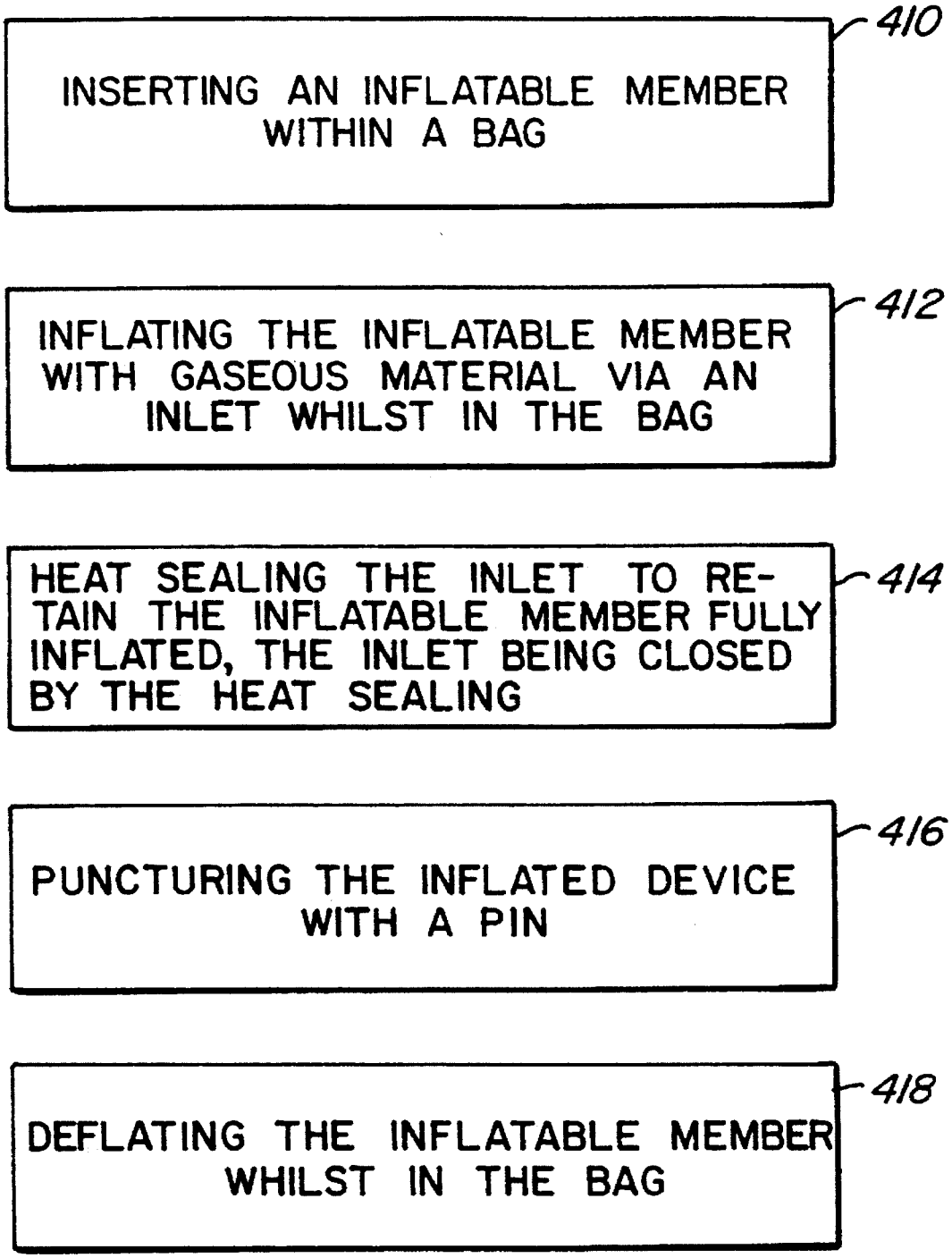
FIG. 4 is a flow chart of a method according to an embodiment of the present invention.

In FIG. 3 a bag 24 to be displayed in a store is shown having an inflatable member 10 placed therein.

When a bag 24 has been manufactured a plastic inflatable member 10 uninflated is placed inside 410, and the bag 24 is folded up for transport to either the place where the bag is to be displayed for sale, or alternatively a place nearby. At this point, the inflatable member is blown up 412 within the bag 24 by means of a nozzle being placed within the entrance 22 of the inflatable member, whereby air preferably at an air pressure of 75 PSI is injected into the inner containment area 18, such that the inflatable member is blown up from the mode shown in FIG. 1 to the mode shown in FIG. 2 within the bag, such that the bag 24 expands to its full and correct shape, removing any creases of the external surface thereof.

The exit is advantageously provided with an air lock device 20 to prevent air from escaping temporarily until the inflatable member 10 is fully expanded and the exit 22 is properly sealed. The air lock device 20 comprises a portion 28 of the sheet 12 inwardly folded between the sheets 12 and 14 of the inflatable member, such that air can be injected between the sheets 12 and 14 at the exit 22 into the inner containment region 18, but air cannot pass out of the exit 22 since any air passing therefrom forms an air pocket in the overlapping portion 28 causing the overlapping portion 28 to contact the sheet. 14 and, prevent air from continuing to escape from the exit 22. The entrance 22 of the inflatable member 10 is permanently closed by heat-sealing to prevent air from within the inflatable member 10 escaping 414. The zip 26 of the bag 24 is then closed such that the bag 24 is then ready for display in a store.

After the bag 24 has been sold, the inflatable member 10 can be deflated 418 by puncturing 416, for instance by means of a pin being punched-into any part of the external surface of the inflatable member, since the material is of relatively punchable material and thickness. The punctured inflated member 10 is then removed from the bag 24 and disposed.

Such an arrangement is extremely simple to use and is extremely flexible in use, since the inflatable member 10 in a bag can be blown up at much quick rate than the present method of stuffing paper into a bag (indeed up to ten times faster), and furthermore the inflatable members can be easily removed from the bag by puncturing as opposed to having to remove reams and reams of paper.

In FIG. 2, the inflatable member 10 is shown having a substantially rectangular shape, since the bag 24 shown in FIG. 3 is also of a substantially rectangular shape. Basically, the inflatable member 10 when inflated has a shape substantially corresponding to the full and expanded shape of the bag with which it is to be used, and accordingly the inflatable member may be of any shape as long as it, corresponds substantially to the shape of the bag, within which it is to be placed for blowing up. Preferably, the inflatable member 10 has an uninflated shape corresponding to the cross-sectional shape of the bag 24 along the vertical plane on the longitudinal axis thereof.

We claim:

1. A device for giving proper shape to a flexible bag for display purposes, said bag, when placed in proper shape, having a full and expanded shape, said bag having a longitudinal axis, and said bag having a cross-sectional shape along a vertical plane on said longitudinal axis, the device comprising in combination:

said bag;

an inflatable member placed inside the bag and capable of being inflated outwardly to cause the bag to move outwardly to its full and expanded shape, the inflatable member comprising two sheets sealed substantially around the circumference thereof;

an inlet provided in said inflatable member through which gaseous material can be passed in order to expand said inflatable member, said inlet being of heat-sealable material and provided with a gas lock device to prevent gaseous material from escaping, the gas lock device comprising a portion of one of said sheets folded inwardly between said two sheets; and said inlet being closed by heat-sealing with said inflatable member being fully expanded to retain said inflatable member fully inflated.

2. A device as claimed in claim 1 wherein said inflatable member is a heat sealable plastic bag made from polyvinyl chloride.

3. A device as claimed in claim 1 wherein said inflatable member has an inflated shape corresponding substantially to the full and expanded shape of the bag.

4. A device as claimed in claim 1 wherein said inflatable member has an uninflated shape corresponding to the cross-sectional shape of the bag along the vertical plane on the longitudinal axis thereof.

5. A method of displaying a flexible bag comprising:

(a) inserting an inflatable member within said bag;

keeping the member uninflated prior to display;

(c) inflating with gaseous material via a heat-sealable inlet to said inflatable member while in said bag;

(d) heat-sealing said inlet after said step of inflating via a heat-sealable inlet to retain said inflatable member fully inflated; and (e) deflating said inflatable member while in said bag.

6. A method as claimed in claim 5 wherein said inflatable member is inflated immediately prior to display.

7. A method as claimed in claim 5 wherein said inflatable member is deflated after removal from display.

8. A method for giving proper shape to a flexible bag for display purposes comprising:

placing an inflatable member inside the bag to be displayed;

providing an inlet in said inflatable member through which gaseous material can be passed in order to expand said inflatable member, said inlet being of heat-sealable material;

inflating said inflatable member, through said inlet, to cause said bag to move outwardly to its full and expandable site;

closing said inlet by heat-sealing after said inflatable member is fully expanded to retain said inflatable member fully inflated;

deflating said inflatable member by puncturing; and disposing of said inflatable member after deflating.

9. A method for displaying a bag, comprising:

providing a bag having a bag interior;

providing an inflatable member having an inlet;

inserting said inflatable member inside the bag;

inflating said inflatable member, through said inlet to cause said bag to move outwardly;

heat-sealing said inlet after said step of inflating through said inlet to retain said inflatable member fully inflated;

thereafter deflating said inflatable member; and disposing of said inflatable member after deflating.

* * * * *